US005220902A

United States Patent [19]

Caumont

[11] Patent Number: 5,220,902

[45] Date of Patent: Jun. 22, 1993

[54] IGNITION DEVICE FOR INTERNAL COMBUSTION ENGINES

[75] Inventor: Jean-Louis Caumont, Gravigny, France

[73] Assignee: U.S. Philips Corporation, New York, N.Y.

[21] Appl. No.: 914,373

[22] Filed: Jul. 15, 1992

[30] Foreign Application Priority Data

Aug. 28, 1991 [FR] France ..... 91 10670

[51] Int. Cl.[5] ..... F02P 11/00

[52] U.S. Cl. ..... 123/631; 123/630

[58] Field of Search ..... 123/631, 630, 179 BG, 123/603, 652, 149 C, 599

[56] References Cited

U.S. PATENT DOCUMENTS

| | | | |
|---|---|---|---|
| 3,504,373 | 3/1970 | Strelow . | |
| 3,795,235 | 3/1974 | Donohue et al. | 123/631 |
| 3,894,525 | 7/1975 | Haubner et al. . | |
| 3,955,549 | 5/1976 | Burson | 123/631 |
| 4,483,306 | 11/1984 | Kawashima | 123/631 |
| 4,862,861 | 9/1989 | Dogadko et al. | 123/599 |
| 4,909,229 | 3/1990 | Hashizume | 123/631 |
| 4,972,822 | 11/1990 | Hashizume | 123/631 |
| 5,020,506 | 6/1991 | Ozawa | 123/631 |

*Primary Examiner*—Raymond A. Nelli

*Attorney, Agent, or Firm*—Robert J. Kraus

[57] ABSTRACT

The device comprises a magnet which induces several current pulses of alternating polarity in a primary winding, the current being restored in a resistance (R1) in series with a transistor (Ti). The voltage developed across the terminals of the resistance is applied to the input terminal (9) of a control circuit (7), via a capacitance (C), said control circuit (7) causing an interruption of the current generating an overvoltage. The capacitance (C) is charged by a first pulse, via a diode (D), connected in parallel with the transistor (Ti), and a resistance (10). The charge thus acquired remains active at the start of the subsequent principal pulse of opposite polarity, which follows, so that in the case of reverse operation of the engine, reversing the order of appearance of the pulses, no ignition takes place.

9 Claims, 2 Drawing Sheets

IGNITION DEVICE FOR INTERNAL COMBUSTION ENGINES

BACKGROUND OF THE INVENTION

The present invention relates to an ignition device for internal combustion engines, comprising a coil which includes a primary winding and a secondary winding and which is provided with an armature in which the passage of a magnet, driven by the rotation of the engine, produces a variable magnetic flux which induces in the primary winding a current pulse whose interruption causes a high-voltage pulse for a spark plug in the secondary winding, a primary current circuit in which said current is restored and which comprises an impedance in series with an interrupt transistor, and a circuit for controlling the turning on and off of said interrupt transistor, causing the interruption of the current by the turning off of said interrupt transistor when the value of a control signal applied to an input terminal of this circuit exceeds a given threshold value.

A device of this kind is used in small internal combustion engines, for example for lawn mowers, chain saws, hedge trimmers, etc.

A device of this kind is known from German Patent DE 23 14559. The circuit described in the cited document comprises a Darlington-type NPN interrupt transistor with an impedance which is connected in series in its emitter connection and which is in this case a current measuring resistance. The voltage generated by the current in said resistance is applied to the base-emitter region of an NPN transistor which is thus turned on when the current exceeds a given value. This transistor is connected so that its turned-on state turns off the interrupt transistor.

Such a device functions, but is not protected against operation of the engine in the reverse direction.

SUMMARY OF THE INVENTION

It is an object of the invention to provide a device which does not supply an ignition spark when the engine rotates in the reverse direction.

It is another object of the invention to provide a device which enables advancement of the ignition during rotation of the engine in the normal direction, which advancement is variable as a function of the speed and suitably adaptable to the engine requirements.

Thus, a device in accordance with the invention is characterized in that at least a first and a second directly successive current pulse of opposite polarity are induced by the variable magnetic flux, that the control circuit is conceived to trigger the turning off of the interrupt transistor in the course of the second pulse, that the variable voltage developed at the junction between the impedance and the interrupt transistor is applied to the input terminal of the control circuit via a capacitance, and that a current path exists, in series with the capacitance, between the two terminals of the primary winding, which path is conductive at least during the first pulse.

The invention is based on the fact that the known flywheel magnets supply, before the principal current pulse used for the ignition, another pulse of opposite polarity, and on the idea to include in the device a capacitance which is charged by the first pulse and whose charge thus acquired remains active during the subsequent principal pulse, so that in the case of reverse rotation of the engine, reversing the order of appearance of the pulses, the operation is interrupted.

Said current path enables a given charging of the capacitance during the first pulse, the resultant voltage being added to the subsequent control signal, because the control signal per se is supplied via the same capacitance.

A device which comprises a resistance where through the primary current flows and which also comprises a capacitance is known from German Patent DE 15 39180. However, the capacitance in the cited device is connected directly to one end of the primary winding (reference point 28 or "c"), so that voltage resulting from its charge cannot be added to or subtracted from the voltage produced by the current in the resistance.

The safety of operation of the device in accordance with the invention is maximum when said threshold value is determined so that the current is not interrupted by the variable voltage developed at the junction between the impedance and the interrupt transistor during the second electric pulse, unless the capacitance has been precharged beyond a predetermined value by the current of the first pulse.

In a specific embodiment, the interrupt transistor is of a first polarity and said impedance is arranged in its collector path, the control circuit comprises a transistor of a second polarity whose base is connected to said junction via the capacitance, its emitter being connected to the end of the impedance which is not the end connected to the junction, its collector being connected to the base of the interrupt transistor.

In another embodiment, the interrupt transistor is of a first polarity and said impedance is connected in its collector path, the control circuit comprises a transistor of the first polarity whose base is connected to said junction via the transmission capacitance and whose collector is connected to the base of a first transistor of a second polarity, the emitter of which is connected to the end of the impedance which is not the end connected to the junction, its collector being connected to the base of the transistor of the first polarity, and also comprises a second transistor of a second polarity whose emitter is connected to the end of the impedance which is not the end connected to the junction, whose collector is connected to the base of the interrupt transistor, and whose base is connected to the emitter of the transistor of the first polarity.

In another embodiment yet, the interrupt transistor is of a first polarity and said impedance is connected in its collector path, the control circuit comprises a transistor of the first polarity whose base is connected to said junction via the transmission capacitance and whose collector is connected to the end of the impedance which is not the end connected to the junction, and also comprises a transistor of a second polarity whose emitter is connected to the end of the impedance which is not the end connected to the junction, whose collector is connected to the base of the interrupt transistor, and whose base is connected to the emitter of the transistor of the first polarity.

In an alternative embodiment, the switch control circuit also comprises a transistor of a second polarity whose base is connected to the central point of a resistance bridge which interconnects the two ends of the primary winding, whose emitter is connected to the end of the impedance which is not the end connected to the junction, and whose collector is connected to the emitter of said transistor of the first polarity.

In another embodiment, the control circuit also comprises a transistor of a second polarity whose base is connected to the central point of a resistance bridge which interconnects the two ends of the primary winding, whose emitter is connected to the end of the impedance which is not the end connected to the junction, and whose collector is connected to the end of the capacitance which is not the end connected to the junction.

BRIEF DESCRIPTION OF THE DRAWING

The invention will be described in detail hereinafter with reference to the accompanying drawings.

DESCRIPTION OF THE PREFERRED EMBODIMENTS

Figure 1:
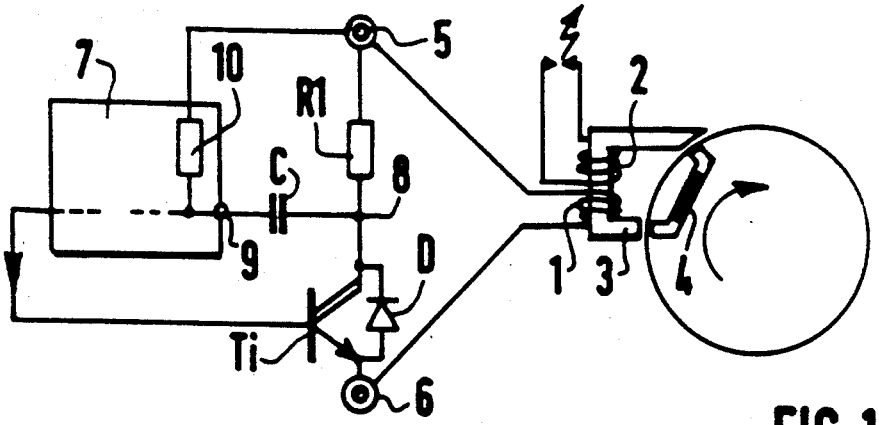
FIG. 1 shows diagrammatically a device in accordance with the invention.

The device shown in FIG. 1 comprises a coil which includes a primary winding 1 and a secondary winding 2. The windings are arranged on an armature 3 in which a magnet 4, driven by the rotation of the engine, produces a variable magnetic flux which induces a current in the primary winding 1.

Interruption of this current causes a high-voltage pulse in the secondary winding, which pulse is intended for a spark plug.

The current of the primary winding 1, derived from the terminals 5 and 6, is restored in a primary current circuit consisting of a resistance R1 in series with an interrupt transistor Ti. The interrupt transistor Ti is of the type NPN and the resistance R1 is arranged in its collector path.

Figure 2A:
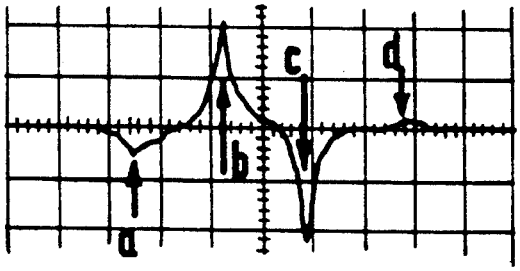
FIGS. 2A and 2B show diagrams of the voltage developed by the winding in the course of time.
Figure 2B:
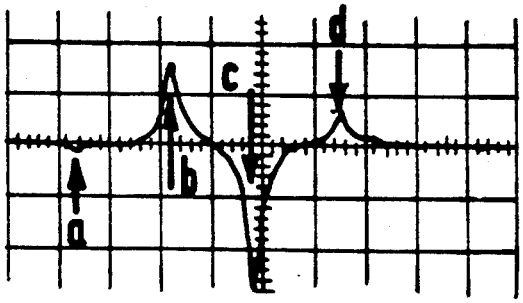

FIG. 2A shows the voltage pulses produced by the primary winding in the case of normal operation with a given geometry of the magnet and armatures chosen by way of example. This trace has been plotted for no-load operation at 1500 revolutions per minute. Each passage of the magnet in front of the coil generates four pulses a, b, c, d, the fourth pulse being very weak. The directly successive first and second pulses, being of opposite polarity, participate in the operation of the circuit. The other two pulses have no role whatsoever during normal operation. FIG. 2B shows the voltage pulses produced during reverse operation. Because of the asymmetry of the shape of the armature of the coil, the shape of the pulses has changed, and the first pulse is now very weak, too weak to play a part, the more so because it disappears completely as soon as the circuit is switched and draws current on the winding. Consequently, the first non-negligible pulse is the pulse "b" which has a polarity which opposes that of the pulse "a" of FIG. 2A. The principal pulse is now the pulse "c" whose polarity opposes that of the pulse "b" of FIG. 2A.

In the circuit shown in FIG. 1, a control circuit 7 for turning the interrupt transistor Ti on and off comprises an input terminal 9 and is connected to the base of the transistor Ti. Its essential function is to turn on first the transistor Ti during the second pulse b, and then to interrupt the current of this transistor. This interruption occurs when the increasing voltage across the input terminal 9 exceeds a given threshold value. The variable signal across the junction 8 between the resistance R1 and the transistor Ti is applied to the input terminal 9, via a capacitance C.

The transistor Ti is in this case formed by a Darlington-type transistor comprising, as a result of its construction, a shunting diode D which is conductive in the current direction which opposes that of the transistor Ti.

A current path in series with the capacitance between the two terminals of the primary winding, which path is conductive at least during the first pulse, is formed by the diode D and a resistance 10 between the input terminal 9 of the control circuit 7 and the terminal 5.

The threshold value on the input 9 of the circuit shown in FIG. 1, at which the interrupt transistor Ti is set to the turn-off state, is determined so that the current is not interrupted by the variable voltage developed across the junction 8 during the second electric pulse, unless the capacitance is precharged by the current of the first pulse. Those skilled in the art can readily achieve this by performing successive experiments during which it will be necessary to vary elements of the circuit 7 in order to vary the trigger threshold until the above condition is satisfied. This will be explained more exactly with reference to the below diagrams which are given by way of example.

Figure 3:
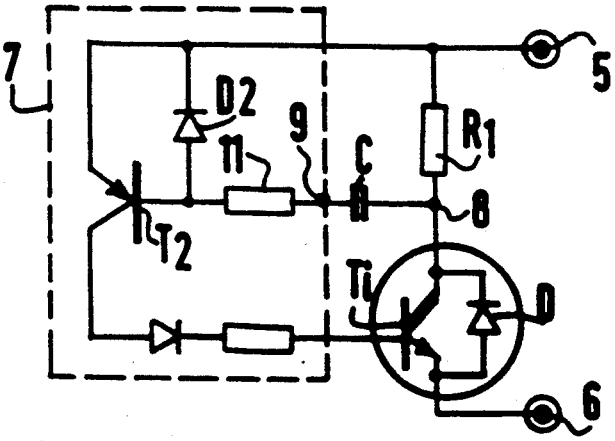
FIGS. 3 to 6 show various embodiments or versions of electrical diagrams of a device.

In the device shown in FIG. 3, the control circuit 7 comprises a PNP-type transistor T2 whose base is connected to the capacitance C via a resistance 11. The other end of the capacitance is connected to the junction 8. The emitter of the transistor T2 is connected to the end of the resistance R1 which is connected to the terminal 5, that is to say the end which is not connected to the junction 8, and its collector is connected to the base of the interrupt transistor Ti via a diode and a resistance connected in series. In series with the resistance 11, a diode D2 forms a current path between the input of the control circuit, that is to say the point 9 connected to the capacitance C, and the end of the impedance R1 which is connected to the terminal 5, that is to say the end which is not connected to the junction 8.

The operation is as follows: the first pulse produces a signal between the terminals 5 and 6 which is more negative on the terminal 5; the capacitance C is thus charged via the elements D, 11, D2 with a negative polarity on its left-hand armature in the Figure; at the start of the second pulse, the negative voltage across the terminals of the capacitance negatively polarizes the base of the transistor T2 with respect to its emitter, thus turning on the transistor; the pulse produces a more positive signal on the terminal 5 and an emitter-collector current thus flows in the transistor T2 which turns on the transistor Ti, and a current starts to flow in R1 and the transistor Ti; the capacitance C is discharged, after which it is possibly charged in the opposite sense because of the fact that the base current of the transistor T2, controlled by the value of the resistance 11, and ultimately the transistor T2 is turned off as well as the transistor Ti. In the absence of a first negative pulse, the capacitance is not charged and the transistor T2 as well as the transistor Ti are turned off until the start of the positive pulse; there is no spark.

This circuit, corresponding to the simplest version of a circuit in accordance with the invention, however, has the drawback that it does not operate if the first pulse is weak, that is to say at a low speed, unless a very powerful magnet is used.

Figure 4:
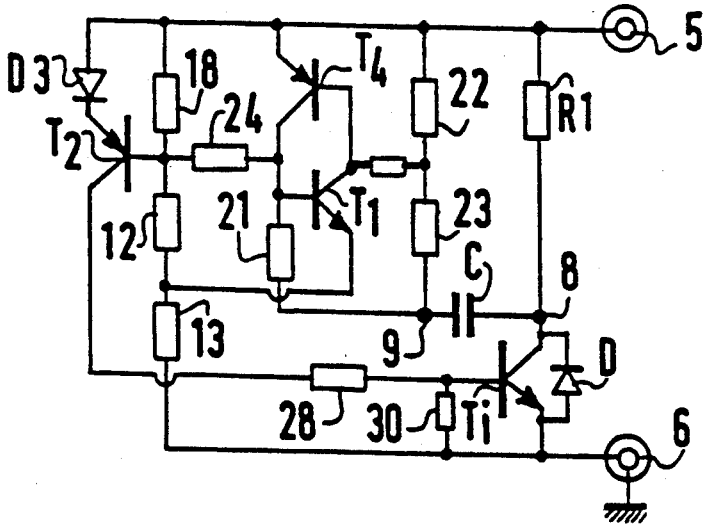
Figure 5:
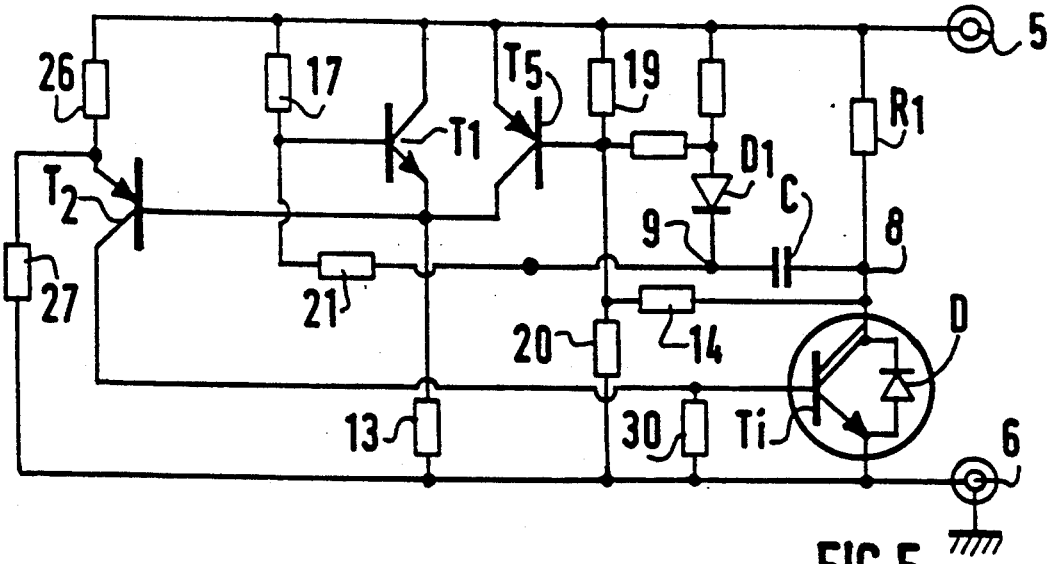
Figure 6:
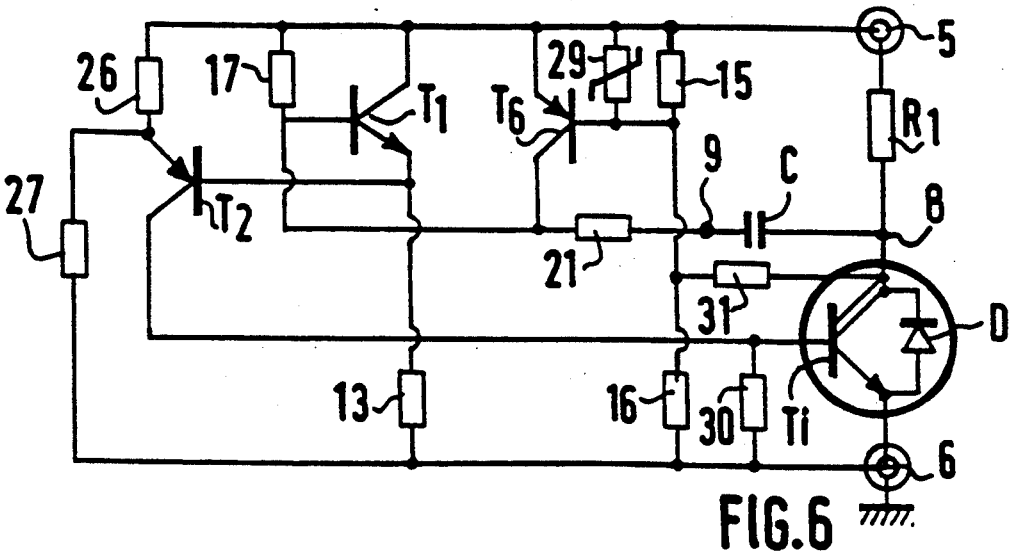

In the circuit shown in the FIGS. 4 to 6, the control circuit comprises an NPN transistor T1 whose base is connected, via the capacitance C, to the junction 8, via a resistance 21 in series with the capacitance C.

A second transistor T2 of the type PNP has its emitter connected to the resistance R1 at the side of the terminal 5. In the circuit shown in FIG. 4, a diode is inserted in this connection. In the circuits shown in the FIGS. 5 and 6, a resistance 26 is inserted therein. The collector of the transistor T2 is connected to the base of the interrupt transistor. In the circuit shown in FIG. 4, a resistance 28 is connected in series in the connection. The base of the PNP transistor T2 is connected to the emitter of the NPN transistor T1. In the circuit shown in FIG. 4, a resistance 12 is inserted in the connection. The base of the transistor T2 is also connected to the emitter of the interrupt transistor, via one or more resistances, that is to say the resistance 13 in the circuits shown in the FIGS. 5 and 6, and the series-connected resistances 12 and 13 in the circuit shown in FIG. 4. A resistance 30, possibly integrated in the transistor Ti, connects the base of the transistor Ti to the terminal 6.

It will be assumed hereinafter that the terminal 6 is connected to ground. This is merely a convention which serves to remove ambiguity for given explanations.

In the circuit shown in FIG. 4, the base of the transistor T1 is connected to the collector of a PNP transistor T4 whose emitter is connected to the terminal 5 and whose base is connected to the collector of the NPN transistor T1. The two transistors T1 and T4 are thus connected as a thyristor in known manner, thus preventing the transistor T1 from being turned off again once it has been turned on. Two series-connected resistances 22, 23 are arranged between the terminal 5 and the point 9. A resistance 24 is also connected between the base of the transistor T2 and that of the transistor T1 and a resistance 18 is connected between the terminal 5 and the base of the transistor T2.

In the circuits shown in the FIGS. 5 and 6, the collector of the transistor T1 is connected to the end of the impedance R1 which is connected to the terminal 5, that is to say to the end which is not connected to the junction 8. Its base is also connected to the terminal 5, via a resistance 17.

A current path between the armature of the capacitance, at the left in the Figures, and the end of the impedance R1, at the top in the Figures, for charging the capacitance during the first negative pulse, is formed by one or more series-connected resistances: the resistances 22, 23 or the resistances 18, 24, 21 in the circuit shown in FIG. 4, or the resistances 17 and 21 in the circuits shown in the FIGS. 5, 6.

The threshold value on the input 9 at which the transistor Ti is turned off can be controlled in the circuit of FIG. 4 by way of the values of the resistances 12 or 13 or 18, and in the circuits shown in the FIGS. 5 and 6 by way of the ratio of the resistance bridge 17, 21. The value of the base voltage which turns on the transistor T2 is also an important element for fixing the triggering threshold. Elements such as the diode D3 or the resistance 26 raise this voltage to the desired value.

These three circuits operate as follows: when a positive voltage appears across the terminal 5 with respect to the terminal 6, a current starts to flow via the emitter-base junction of the transistor T2 and proceeds in the direction of the terminal 6, via the resistances 12 and/or 13; the transistor T2 is thus turned on and feeds the base of the transistor Ti which is thus turned on; therefore, the voltage across the point 8 is near that across the point 6 and the voltage across the point 9 is even lower, considering the prior charging of the capacitance C in response to the first negative pulse (as has already been explained with reference to FIG. 3), so that the transistor T1 is turned off; a part of the current flowing in the transistor Ti flows via the resistance R1, but also via the current path already mentioned, thus rendering the voltage across the armature 9 of the capacitance C increasingly more positive; after a given delay, this voltage across the point 9 is high enough to turn on the transistor T1, which causes the voltage across the base of the transistor T2 to increase; the latter is then turned off as well as the transistor Ti.

It will be evident that when the engine rotates in the reverse direction, the capacitance C is no longer precharged by the first pulse and that the operation changes. A spark can still be produced, but it is significantly shifted in time.

In the circuit shown in FIG. 4, the junction of the base of the transistor T4 and the collector of the transistor T1 is connected, via a resistance, to the central point of the bridge consisting of two resistances 22, 23. This enables direct turning on of the transistor T4 at a high speed, the capacitance C then supplying the bridge 22, 23, before it has had the opportunity to discharge itself, with the voltage formed across the terminals of the resistance R1 by the leading edge of the current. Thus, the ignition is advanced.

In the circuits shown in FIGS. 5 and 6, the emitter of the transistor T2 is connected to the end 6 of the primary winding, via a resistance 27.

In the circuit shown in FIG. 5, the control circuit also comprises a PNP transistor T5 whose base is connected to the central point of a star-like network consisting of three resistances 19, 20, 14. Each of these resistances is connected, from the side opposite the central point, to the terminal 5, that is to say to the junction of the primary winding and the resistance R1, to the end 6 of the primary winding, and to the end 8 of the impedance R1, respectively. Alternatively, the resistance 20 or the resistance 14 may be infinite, i.e. absent. The emitter of the transistor T5 is connected to the end of the resistance R1 which is not the end connected to the junction 8, and its collector is connected to the emitter of the NPN transistor T1, that is to say to the base of the transistor T2. Moreover, via its anode, a diode D1 is connected to the intermediate point of two series-connected resistances connecting the terminal 5 to the base of the transistor T5, its cathode being connected to the end of the capacitance C at the side of the transistor T1. This diode enables a restoration of the voltage across the terminal 9 of the capacitance which is much faster than that which would be obtained exclusively via the resistances 17 and 21.

The transistor T5 is turned off at the beginning of a positive pulse, because the voltage obtained across the terminals of the resistance 19 on the basis of that between the terminals 5 and 6 or between the terminals 5 and 8 by division in the resistance bridges 20, 19 and 14, 19 is lower than the emitter-base voltage which would turn on the transistor T5. When this voltage has increased, the transistor T5 is turned on, thus turning off the transistor T2 as when the transistor T1 is turned on. Thus, the transistors T5 and T1 act respectively, the first transistor to act being the relevant one: at a high speed, it is T5 which acts first, enabling an advancement of the ignition. The passage from one mode of operation to the other takes place abruptly at a given speed.

The circuit shown in FIG. 6 is the preferred version and is derived from that of FIG. 5: the control circuit comprises a PNP transistor T6 whose base is connected to the central point of a star-like network of three resistances 15, 16, 31. From the side opposite the central point, each of these resistances is connected to the terminal 5, that is to say to the junction of the primary winding and the resistance R1, to the end 6 of the primary winding, and to the end 8 of the impedance R1, respectively. Alternatively, the resistance 16 or the resistance 31 may be infinite, i.e. absent. The emitter-collector path of the transistor T6 is not connected parallel to that of the transistor T1 as is the case for the transistor T5 of FIG. 5, but constitutes a connection between the terminal 5 and the armature, at the left in the Figure, of the capacitance C. Instead of acting directly so as to turn off the transistor T2 as is done by the transistor T5 of FIG. 5, the transistor T6, when turned on, adds a supplementary current to that flowing through the resistance 17, resulting in a faster increase of the voltage across the armature 9 of the capacitance C; thus, the ignition is advanced, which advancement varies progressively as a function of speed as from a given state.

When the transistor Ti is turned off, the positive voltage increases very quickly across the terminal 5 of the primary winding because of the self-inductance. The corresponding current in the chain of elements formed by the resistance 17, the baseemitter region of the transistor T1 and the resistance 13 could develop a voltage across the terminals of the resistance 17 which would be sufficient to turn on the transistor T2 again. The resistance bridge 26, 27 varies the emitter voltage of the transistor T2 so that it follows the rise of the voltage applied to its base, thus avoiding the described drawback.

Satisfactory operation of the circuit shown in FIG. 6 is obtained by means of a resistance R1 in the order of from 1 to 2 Ω, a capacitance in the order of 27 nF, resistances 21, 17, 13, 15, 16, 26, 27, 30 in the order of 1.5 kΩ, 40 kΩ, 15 kΩ, 5 kΩ, 40 kΩ, 50 kΩ, 7 kΩ, 3 kΩ, respectively. When these values are chosen, the resistance 31 is not used. An element 29, consisting of a resistance of approximately 5 kΩ in series with a resistance which is referred to as CTN and which amounts to 15 kΩ, is also connected between the terminal 5 and the base of the transistor T6 in order to maintain the characteristics in response to temperature fluctuations. The transistors Ti and T2 are high-voltage types.

The invention is not restricted to the embodiments described above. For example, the resistance 28 of the circuit of FIG. 4 can be added to the circuits shown in the FIGS. 5 and 6, or the chain of resistances 18, 12, 14 of the circuit shown in FIG. 4 can be inserted in the circuits shown in the FIGS. 5 and 6. Moreover, it is substantially equivalent to connect the lower terminal of the resistance 17 of the FIGS. 5 and 6 to the other side of the resistance 21, that is to say directly to the point 9, the resistance 21 having a low ohmic value. In the diagram of FIG. 6, the upper point of this resistance 17, being connected to the power supply terminal 5, may also be connected thereto via the resistance 15, i.e. said resistance 17 is then connected between the base of the transistor T6 and the point 9.

In a more general sense, by inserting the resistance R1 in the emitter connection of the transistor Ti, those skilled in the art can readily conceive a control circuit 7 presenting the required voltage levels (for example, it suffices to use transistors of opposite polarity and to add or to omit a transistor in order to invert the signal applied to the base of the interrupt transistor) so as to reproduce the circuits described herein in a different form. The transistor Ti may also be replaced by another controllable interrupt device, for example a MOS-type transistor.

I claim:

1. An ignition device for internal combustion engines, comprising a coil which includes a primary winding (1) and a secondary winding (2) and which is, provided with an armature (3) in which the passage of a magnet, driven by the rotation of the engine, produces a variable magnetic flux which induces in the primary winding a current pulse whose interruption causes a high-voltage pulse for a spark plug in the secondary winding, a primary current circuit in which said current is restored and which comprises an impedance (R1) in series with an interrupt transistor (Ti), and a circuit (7) for controlling the turning on and off of said interrupt transistor, causing the interruption of the current by the turning off of said interrupt transistor when the value of a control signal applied to an input terminal (9) of this circuit exceeds a given threshold value, characterized in that at least a first (a) and a second (b) directly successive current pulse of opposite polarity are induced by the variable magnetic flux, that the control circuit is conceived to trigger the turning off of the interrupt transistor in the course of the second pulse (b), that the variable voltage developed at the junction (8) between the impedance (R1) and the interrupt transistor (Ti) is applied to the input terminal (9) of the control circuit, via a capacitance (C), and that a current path (D, 10) exists, in series with the capacitance, between the two terminals (5, 6) of the primary winding, which path is conductive at least during the first pulse.

2. A device as claimed in claim 1, characterized in that said threshold value is determined so that the current is not interrupted by the variable voltage developed at the junction (8) between the impedance and the interrupt transistor during the second electric pulse, unless the capacitance (C) has been precharged by the current of the first pulse (a).

3. A device as claimed in any one of the claims 1 or 2, characterized in that the interrupt transistor (Ti) is of a first polarity and said impedance (R1) is arranged in its collector path, the control circuit comprises a transistor (T2) of a second polarity whose base is connected to said junction (8) via the capacitance (C), its emitter being connected to the end (5) of the impedance (R1) which is not the end connected to the junction (8), its collector being connected to the base of the interrupt transistor (Ti).

4. A device as claimed in any one of the claims 1 or 2, characterized in that the interrupt transistor (Ti) is of a first polarity and said impedance (R1) is connected in its collector path, the control circuit comprises a transistor of the first polarity (T1) whose base is connected to said junction (8) via the transmission capacitance (C), and whose collector is connected to the base of a first transistor (T4) of a second polarity, the emitter of which is connected to the end (5) of the impedance which is not the end connected to the junction (8), its collector being connected to the base of the transistor (T1) of the first polarity, and also comprises a second transistor (T2) of a second polarity whose emitter is connected to the end (5) of the impedance which is not the end connected to the junction (8), whose collector is connected to the base of the interrupt transistor (Ti), and whose base is connected to the emitter of the transistor (T1) of the first polarity.

5. A device as claimed in any one of the claims 1 or 2, characterized in that the interrupt transistor (Ti) is of a first polarity and said impedance (R1) is connected in its collector path, the control circuit comprises a transistor of the first polarity (T1) whose base is connected to said junction (8) via the transmission capacitance (C) and whose collector is connected to the end (5) of the impedance which is not the end connected to the junction, and also comprises a transistor (T2) of a second polarity whose emitter is connected to the end (5) of the impedance which is not the end connected to the junction (8), whose collector is connected to the base of the interrupt transistor (Ti), and whose base is connected to the emitter of the transistor (T1) of the first polarity.

6. A device as claimed in claim 5, characterized in that the switch control circuit also comprises a transistor (T5) of a second polarity whose base is connected to the central point of a resistance bridge (19, 20) which interconnects the two ends (5, 6) of the primary winding, whose emitter is connected to the end (5) of the impedance which is not the end connected to the junction (8), and whose collector is connected to the base of said transistor (T2) of the second polarity.

7. A device as claimed in claim 5, characterized in that the switch control circuit also comprises a transistor (T6) of a second polarity whose base is connected to the central point of a resistance bridge (15, 16) which interconnects the two ends (5, 6) of the primary winding, whose emitter is connected to the end (5) of the impedance which is not the end connected to the junction (8), and whose collector is connected to the end of the capacitance (C) which is not the end connected to the junction (8).

8. A device as claimed in claim 5, characterized in that the switch control circuit also comprises a transistor of a second polarity (T5) whose base is connected to the central point of a resistance bridge (19, 14) which interconnects the two ends of the impedance (R1), whose emitter is connected to the end (5) of the impedance which is not the end connected to the junction (8), and whose collector is connected to the base of said transistor (T2) of the second polarity.

9. A device as claimed in claim 5, characterized in that the switch control circuit also comprises a transistor of a second polarity (T6) whose base is connected to the central point of a resistance bridge (15, 31) which interconnects the two ends of the impedance (R1), whose emitter is connected to the end (5) of the impedance which is not the end connected to the junction (8), and whose collector is connected to the end of the capacitance (C) which is not the end connected to the junction (8).

* * * * *